United States Patent [19]

Dashew et al.

[11] 3,980,038

[45] Sept. 14, 1976

[54] HOSE AND MOORING LINE POSITIONING SYSTEM

[75] Inventors: Stanley A. Dashew, Santa Monica; Charles D. Sutton, Woodland Hills, both of Calif.

[73] Assignee: Omnithruster, Inc., Compton, Calif.

[22] Filed: Mar. 31, 1975

[21] Appl. No.: 563,643

[52] U.S. Cl. ..... 114/230; 9/8 P; 114/144 A; 114/144 B

[51] Int. Cl.[2] ..... B63B 21/50

[58] Field of Search..... 9/8 P; 114/.5 T, 144 E, 114/144 B, 144 A, 151, 230; 115/12 R, 14

[56] References Cited

UNITED STATES PATENTS

| | | | |
|---|---|---|---|
| 3,321,923 | 5/1967 | Smith et al. | 115/12 R X |
| 3,595,195 | 7/1971 | Van Eek et al. | 9/8 P X |
| 3,664,286 | 5/1972 | Chaney | 9/8 P X |
| 3,867,712 | 2/1975 | Harthill et al. | 114/144 B X |

OTHER PUBLICATIONS

Maritime Administration Research and Developement Report, 10–1974, pp. 4–1–4–19.

*Primary Examiner*—Stephen G. Kunin
*Attorney, Agent, or Firm*—Lindenberg, Freilich, Wasserman, Rosen & Fernandez

[57] ABSTRACT

This invention provides a system for maintaining hoses and mooring lines extending outwardly from a single buoy mooring terminal, in a desired direction. Also provided is an arrangement for directing the mooring line and hose to move to a ship.

15 Claims, 18 Drawing Figures

HOSE AND MOORING LINE POSITIONING SYSTEM

BACKGROUND OF THE INVENTION

This invention relates to an improved system for keeping a hose and mooring line extending from a single buoy mooring terminal in a desired direction and for facilitating the mooring of said ship to said terminal.

Present day tankers and super tankers, which carry liquids, such as oil, slurries or liquified natural gas require a draft of a size such that they are unable to tie up to the docks in the vast majority of the ports around the world. Therefore, normally, these ships are anchored at a distance offshore where they are loaded and unloaded. An increasingly popular means of loading and unloading these ships is to have them tie up to a floating mooring buoy, commonly known as a single mooring buoy terminal or SMB. Hoses from offshore run along the ocean bottom and come up underneath the buoy from whence they communicate through swivel couplings to hoses extending from the buoy to the ships. Provision is made on the buoy so that the ships can swivel around the buoy in response to the effects of the wind, waves and tides and still be moored and coupled to the hoses.

The mooring lines and hoses extending from the buoy to the ship, are normally left floating on the surface of the ocean. When a ship desires to be moored, normally a tug is sent out to pick up the mooring cables, extending from the buoy, as well as the hoses and brings these to the ship. It will be appreciated that this can be rather expensive and if possible a more expedient and economical way should be found to do the job. Not only is the use of a tug's services performing this job costly, but if it should happen that for reasons such as weather, a ship has to waste time waiting for the tug to come out this stand-by time may be even more costly than the price of the services of the tug.

Another problem arises when a hose and mooring cable, which often times are any where from 300 to 1000 feet long, are left floating on the surface of the sea. Under the influence of the wind and tides these become wrapped around the mooring buoy. A tug has to be sent out to unwrap the hose and mooring cable from around the buoy before a ship can tie up to these. This too is a costly procedure.

OBJECT AND SUMMARY OF THE INVENTION

An object of this invention is the provision of a system for automatically maintaining the hose and mooring cable extending from a mooring buoy in a desired direction.

Yet another object of this invention is the provision of an arrangement for enabling the hose and mooring cable extending from a mooring buoy, to be directed toward a ship which desires to tie up to the mooring buoy.

Yet another object of the present invention is the provision of an arrangement for preventing a hose and mooring cable from wrapping around a mooring buoy.

Still another object of the present invention is the provision of an arrangement for enabling a simple and economical way for a ship to moor to a SMB.

The foregoing and other objects of the invention are achieved by either tethering the free end of floating hoses and a floating mooring line, to a small controlled vessel, or attaching the controlled vessel directly to the hoses and mooring line. Another alternative is to use a separate vessel for cable and for mooring line. The buoy will have means for indicating the direction desired for the hoses and mooring line to extend. The controlled vessel will have means, in one embodiment for generating a signal, whenever it deviates from the desired direction. In the first embodiment, the signals indicative of the vessel heading are compared with signals representative of the desired heading for producing an error signal. This is transmitted to the vessel, which has thereon a propulsion system which may be remotely controlled. The error signal is applied to this propulsion system which responds by heading in the desired direction and moving in this direction for a predetermined interval to insure that the hose and mooring line are extending in the desired direction.

In an alternative system, means are provided on the buoy for radiating signals in the direction in which it is desired to maintain the hose and mooring line extended. Two different signals may be radiated to bracket the desired direction of extension of the hoses and mooring buoy and sensing means provided on the vessel which responds to sensing one or the other of the bracketing signals to automatically cause the vessel to move in a direction to return between the two bracketing signals and to continue moving for a predetermined interval to insure that the hose and mooring line are extending in the desired direction. Alternatively a single signal may be radiated. There are two sensors on the ship, and when the vessel has moved so that only one of these sensors is illuminated, the vessel will be activated to automatically return to activate both sensors thereby towing the hose and mooring cable back into the region of illumination by the signal and thereby they extend in the desired direction.

In another arrangement a transmitter sends out radiation in a manner to continuously scan the seas around the buoy. These radiations are reflected from a target on the controlled vessel back to the buoy. There, in a well known manner, the distance and azimuth of the vessel are determined, compared with desired distance and azimuth, and corrective signals, if required are sent to the vessel which responds thereto to make the hoses and mooring lines assume the desired azimuth.

Provision is also made for a control signal radio receiver either on the mooring buoy or on the controlled vessel. A ship may transmit signals to such a receiver or a ship may give directional signals to a shore station which transmits signals to such receiver. The receiver provides an override signal to the circuitry which serves to direct the vessel to position the hose and line so that they extend in a desired direction, and instead the vessel will respond to directional signals received by the radio and applied to the vessel control and propulsion system to guide the vessel to the ship so that hoses and mooring line can be picked up and the ship can both moor itself to the mooring buoy and couple to the hoses.

The direction in which it is desired that the hose and mooring line may extend may be established by sensing the direction of the wind and tide and instructing the propulsion system in the controlling vessel to head either downwind, or in the direction of the tide, or in the direction of a vector of the two. The wind and tide sensing equipment together with the control radio may be all located on the vessel, if desired.

The reason the downwind or tidal direction of extension is preferred is that normally a ship moors downwind or in a "down" tide direction from a mooring. Thus the mooring lines and hoses are positioned at a location to which the ship normally comes for a mooring.

The controlled vessel will hereafter be "omnitug".

The novel features of the invention are set forth with particularity in the appended claims. The invention will best be understood from the following description when read in conjunction with the accompanying drawings.

A BRIEF DESCRIPTION OF THE DRAWINGS

DESCRIPTION OF THE EMBODIMENT OF THE INVENTION

Figure 1:
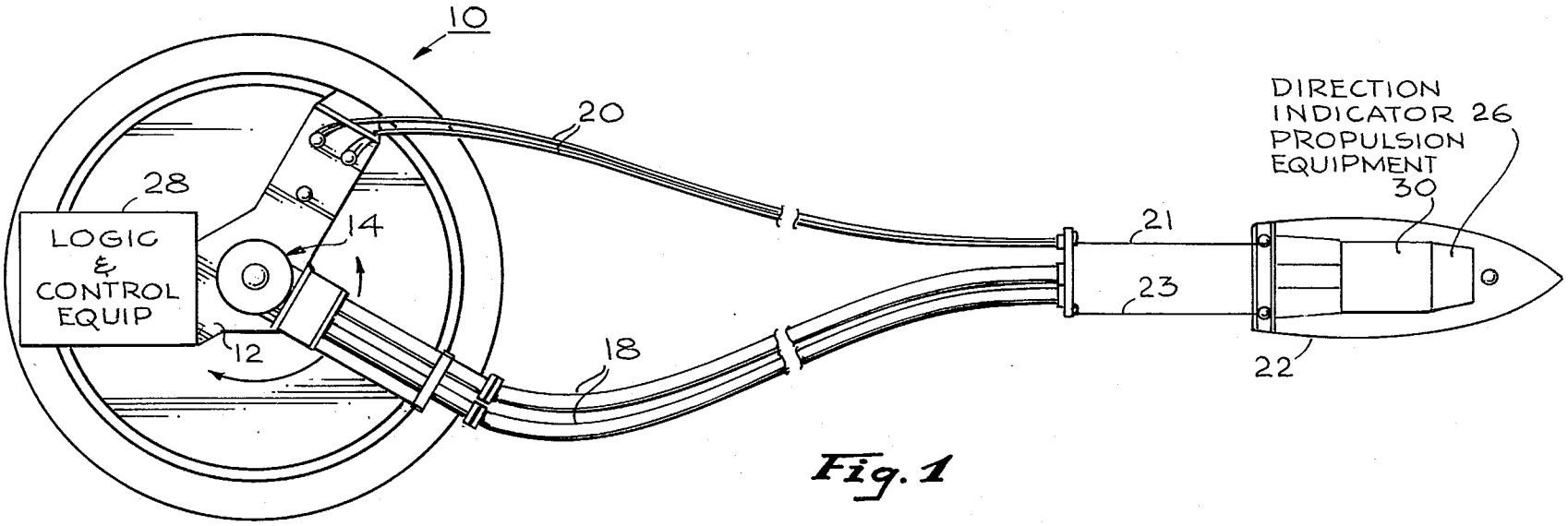
FIG. 1 is a plan view illustrating a mooring buoy with an extending hose and mooring lines and including a schematic illustration of an embodiment of the invention.
Figure 2:
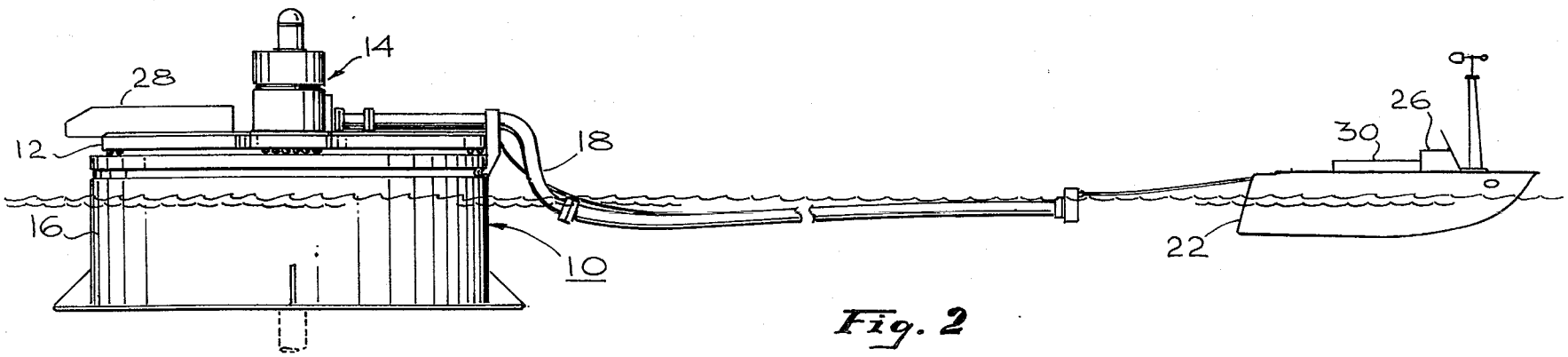
FIG. 2 is a view in elevation of the structure of FIG. 1.

Reference will now be made to FIGS. 1 and 2 where there is schematically represented in plan and elevation a single mooring buoy terminal (SMB) 10, having a rotatable top 12. From the center of the buoy there extends a structure 14, which is rotatable along with the rotatable top deck 12, with respect to the main body of the buoy 16, which floats in the water and which is anchored to the bottom by suitable means, not shown. The structure 14, which can be found generally described in patents such as U.S. Pat. Nos. 2,894,268 and 3,067,716, has one or more hoses 18 which couple through a swivel joint on the buoy, to hoses which extend from underneath the buoy (not shown) along the bottom to a land station. Also attached to the structure 14 as well as to the rotating deck structure 12 are several floating mooring hawsers here represented by a single line 20. The mooring hawsers normally extend outward from the buoy a few hundred feet. From the end of the hawsers 20 there extends a mooring line 21, usually picked up by a ship which wishes to moor to the SMB. The hoses 18, which float, also extend outwardly several hundred feet and are attached to mooring lines 23. A small controlled omnitug 22 is attached to the end of the mooring lines 21 and 24.

In accordance with this invention, there is positioned on the omnitug a direction indicator 26, such as a compass of the well known type, which generates signals indicative of the direction in which the vessel 22 is heading. This may be a radio compass if desired. These signals are sent back to logic and control equipment and power supplies 28, which are supported on the buoy. The connection between the direction indicator and the logic and control equipment may be by radio or by a line, suitably protected against the effects of the elements to which they are exposed, which is attached to the hose and runs back to the buoy 10.

In response to the signals from the direction indicator on the omnitug the logic and control equipment 28 on board the buoy compare these signals, indicating the heading of the vessel, with signals indicating the direction in which it is desired that the hose and mooring buoy extend and generate error signals in response to the difference. These error signals are returned by wire or radio to propulsion control equipment 30, on board the vessel. This propulsion control equipment is equipment which, in response to these error signals starts up a propulsion motor and directs steering equipment to steer the vessel in a direction to minimize and eliminate the error signal.

Figure 3:
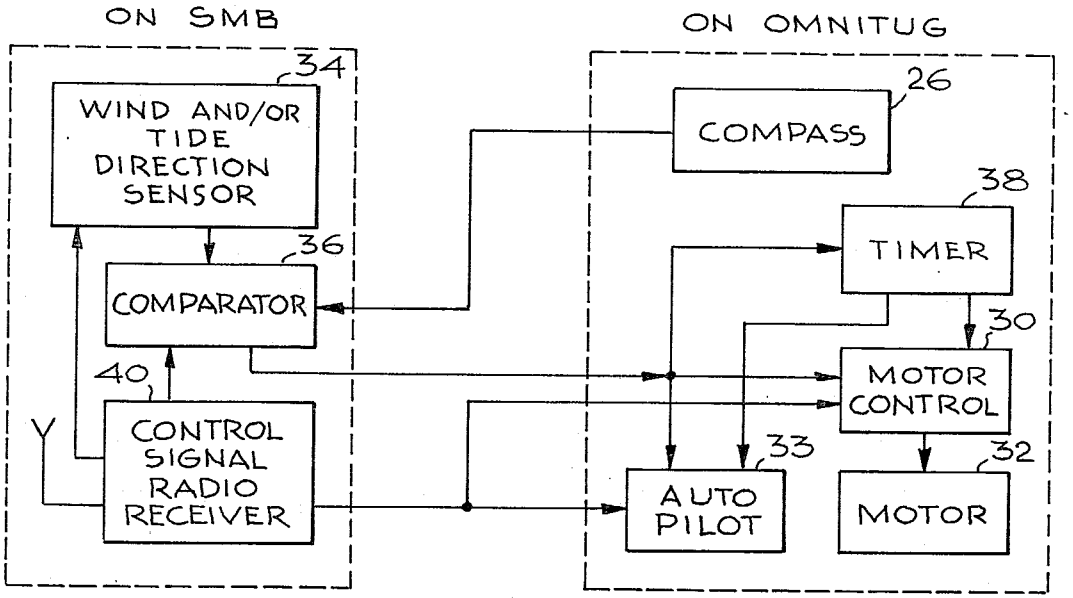
FIG. 3 is a schematic diagram of the electrical equipment required on a buoy and on the omnitug in accordance with this invention.

FIG. 3 illustrates schematically the electronic and control equipment required on the buoy and on the omnitug, in accordance with this invention. As already described, on the vessel there will be a direction indicator such as a compass 26, a motor control circuit 30, propulsion motor 32 and automatic pilot equipment 33 for steering and omnitug. All of the equipment on the omnitug is well known and commercially purchasable. However, the automatic pilot will respond to direction signals received from the buoy, instead of from a compass, as is usual. Since the compass signals are electrical signals, it is immaterial to the automatic pilot what their source is.

It may be desirable, depending upon the circumstances of the location of the buoy, to either cause the hose and mooring line to extend downwind at all times, or to extend in the direction of the wind and the tide, or to extend in the direction of a vector, which is the resultant of wind and tide. The equipment for generating electrical signals representative of wind and/or tide directions are well known, and is here represented by a "wind and/or tide direction sensor 34." The signals indicative of the omnitug heading, transmitted from the compass 26, are applied to a comparator 36, together with the signal from the desired direction sensor 34, which indicate the direction in which it is desired that the hose and mooring hawsers extend. The comparator is a well known electrical circuit which can compare signals, and produce an output when ever there is a difference, which output has a polarity, depending upon which of the input signals is larger. Such a comparator may be, for example, a circuit known as a differential amplifier.

The error signal output of the comparator 36 is applied to the motor control circuit 30 to cause the motor to become operative and start propulsion and is also applied to the automatic pilot equipment 34 to enable it to steer the omnitug in a direction to minimize the error signal provided by the comparator. When the compass heading and the direction signals from the wind direction sensor are such that the comparator output becomes minimal or zero the omnitug is headed in the proper direction.

In order to maintain the hoses and mooring line properly extended, a timer 38 located on the omnitug is activated by the error signal. When the error signal ends, the timer produces a signal which maintains the control circuit and the automatic pilot on for a predetermined interval to propel the vessel straight ahead. The purpose of this operation is to keep the hose and mooring cable extended in the direction in which the vessel is facing. If, during that time, error signals are received from the comparator, then these will override the timer signal and the automatic pilot will steer the omnitug in the direction indicated by the error signal.

In addition to the foregoing equipment, there is mounted on the mooring buoy, a control signal radio receiver 40. This receiver will receive control signals either directly from a ship, or in response to signals transmitted from a shore station whih is receiving instructions from the ship. When the radio receiver 40 receives these signals, it turns off the comparator and wind direction sensor and sends direction signals, which may be of the same type as those otherwise received from the comparator, to the motor control circuit and automatic pilot. In response to these signals the omnitug moves to the ship or tanker pulling the lines coupled to the mooring lines and hoses therewith, where these can be picked up, uncoupled from the hoses and mooring lines for mooring the ship and coupling to the hoses. The lines 21 and 23 are used to hold the omnitug until the tanker has finished either unloading or loading. At this time, the crew connects the lines back to the mooring lines and hoses, these are then dropped back into the ocean and the ship then leaves.

If desired, all of the equipment on the mooring buoy may be mounted on the omnitug to eliminate sending signals to and from the buoy. The omnitug can carry its own power generator or can be electrically powered by conductors extending from the buoy.

Figure 4:
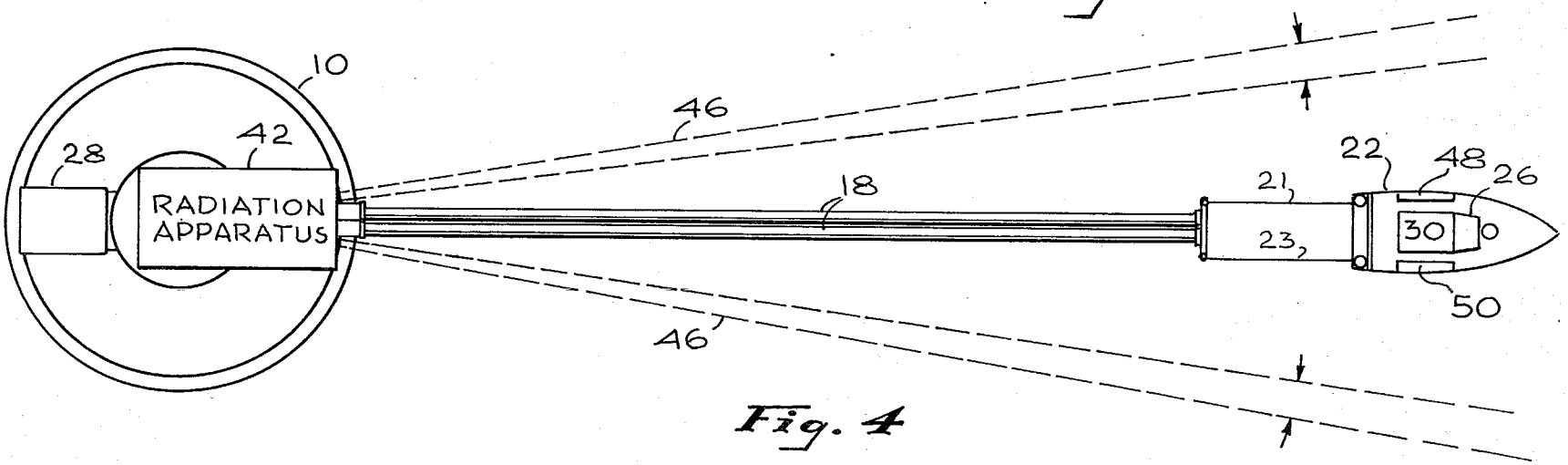
FIG. 4 is a plan view of another arrangement for directing a hose and mooring cable to extend in a desired direction from the mooring buoy.
Figure 5:
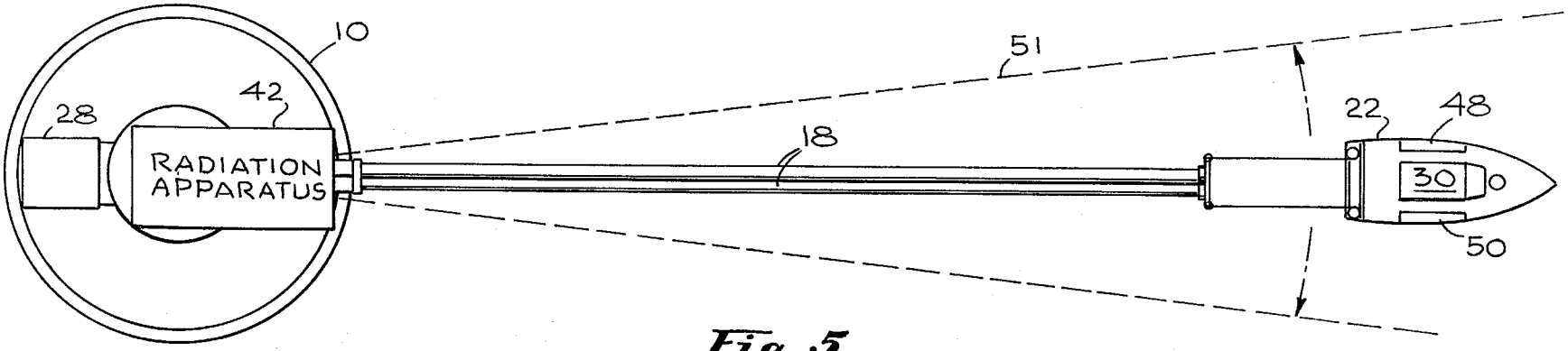
FIG. 5 is a fractional view of another radiation pattern which may be used for maintaining a hose and mooring cable extending in a desired direction, in accordance with this invention.

FIG. 4 and FIG. 5 illustrate two other arrangements for maintaining a hose and mooring line extending from a mooring buoy in a desired direction. In FIG. 4, structures similar to those shown in the previous figures are given the same reference numerals. The hawsers and mooring lines have been omitted from these drawings for the sake of simplifying the drawings.

In FIG. 4, there is shown an arrangement wherein radiation apparatus 42, radiates two beams, respectively 44, 46, which diverge by a predetermined angle, and are radiated in the direction of the omnitug 22. The angle at which the radiation apparatus 42 radiates the two beams is under the control of the wind and/or tide sensor 34 which is encompassed within the logic control 28. The radiation can be of any suitable type such as two different colored light beams, or two different high frequency radio beams, or two different frequency sonar beams. The spacing between the beams is the zone within which the hoses 18 and mooring lines should extend. The omnitug 22 has two sensors respectively 48 and 50. The sensor 48, when it senses the radiation illumination 44 generates a signal which energizes the propulsion motor and automatic pilot equipment whereby the omnitug 22 is caused to turn to the region between the two beams 44, 46. The automatic pilot equipment is eneregized to turn the omnitug 22 to the right or in the direction between the two beams so long as the sensor 22, which is only sensitive to the radiation beam 44, detects that radiation beam.

Similarly, should the omnitug pulling hose and mooring lines bear to the right into the beam of radiation 46, sensor 50 in response thereto generates a signal in response to which the propulsion motor and steering equipment on the omnitug 22 are actuated to return the omnitug and thereby the hoses and mooring lines to the region between the two radiation beams. After the omnitug has returned to the region between the radiation beams, the propulsion motor and direction control equipment are not turned off, but are maintained on for a predetermined interval by a timer for the purpose of having the omnitug straighten out the hoses and/or mooring lines. That is, for a predetermined interval after the omnitug has returned to the region between the two radiation beams, the propulsion system is instructed by the timer output to steer the vessel in a straight line away from the mooring buoy and the propulsion system or motor is also maintained on for this interval.

FIG. 5 is a fractional view showing another arrangement for maintaining the hoses and mooring lines extended away from the mooring buoy in a desired direction. Here, the radiation apparatus 42 only radiates a single beam 51 having a predetermined width in the direction in which it is desired the mooring lines and hoses to extend. Again, the omnitug 22 is equipped with two sensors, a right sensor 48 and a left sensor 50. Both sensors are responsive to the illumination of the single beam 51, and both send back signals to the logic and control equipment 28 on the mooring buoy indicative of their being illuminated.

In the presence of both signals nothing occurs, since this is indicative of the fact that the omnitug 22 is properly positioned. However, should the omnitug drift so that one of the sensors is no longer illuminated by the radiation beam 52, this is sensed and the logic and control equipment then signals the propulsion motor and direction control equipment on the omnitug to cause the motor to commence operation to propel the omnitug and to steer the omnitug in a direction so that both sensors will become illuminated. Here again, a timer is activated, following the return of the omnitug to the region of the beam to maintain the propulsion system and direction control system for a predetermined time, operative directing the boat to pull the hose and mooring lines straight out in the desired direction.

The kind of radiation apparatus, and the associated sensors which for the purpose indicated can be used, can be for example, light radiation, where the light is of two different colors, or ultra high frequency radiation, where the two different beams are of two different electromagnetic frequencies, or sonar or underwater sound radiation where the two different beams are radiated at two different frequencies. Techniques are well known for radiating directional beams of these various frequencies which directional beams will have a predetermined width. Also well known is the sensor equipment for responding to the reception or non-reception, as the case may be, of radiation. In the case of light radiation, the sensors can be photocells which have filters to render them sensitive to one or the other of the two light illuminations. In the case of ultra high frequency electromagnetic radiation, the sensors can be antennae and tuned receivers, specifically tuned to receive the respective radiation frequencies. Likewise, sonar transducers can be used to receive the underwater radiation. Obviously the sonar transducers or sensors would be placed in the ocean underneath the vessel. This equipment is all commercially purchasable.

Figure 7:
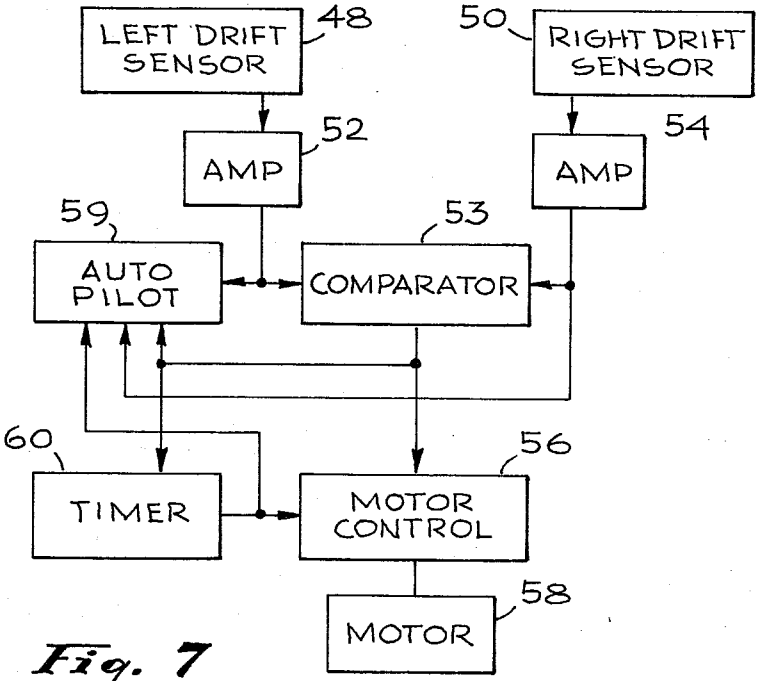
FIG. 7 is a block schematic diagram of the electrical equipment required on a vessel for the embodiment of the invention represented in FIG. 6.
Figure 6:
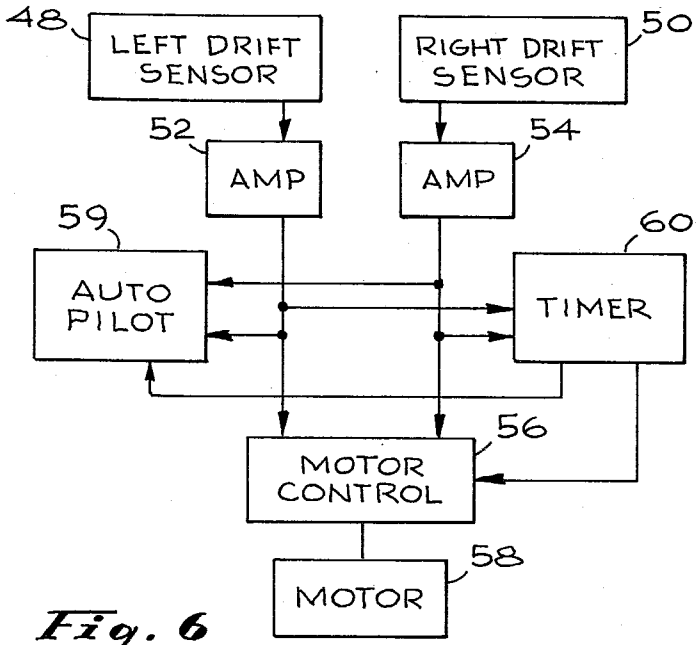
FIG. 6 is a block schematic diagram of the electrical equipment required on an omnitug for the embodiment of the invention shown in FIG. 5.

FIG. 6 and FIG. 7 are respective schematic drawings of the electrical equipment required for the respective two beam and one beam systems represented in FIGS. 4 and 5 for maintaining the hoses and mooring line extending away from the buoy in a desired direction. On the omnitug there is a left drift sensor 48 and a right drift sensor 50, which correspond to the sensors shown in FIGS. 4 and 5. In the structure shown in FIG. 4, when the boat drifts into one of the other of the two beams, one or the other of the sensors generates a signal which is amplified by the respective amplifiers, 52, 54, and the amplified signal is applied to the motor control 58 and the automatic pilot 59 so that the omnitug will be propelled in the direction which is indicated by the signal received from one or the other of the sensors 48, 50.

A timer 60, in response to one or the other of the output signals of the amplifiers 52, 54 is energized, and when the signal from one or the other of the amplifiers 52, 54 terminates, the timer supplies an output signal to the motor and auto pilot apparatus, in response to which the motor will continue to operate and the auto pilot will maintain the omnitug so that it will pull the hose and mooring line in a straight line in the desired direction away from the mooring buoy. This will continue for a predetermined interval.

For the system shown in FIG. 5, where a single radiation beam is directed at both sensors, a schematic of the equipment required on the vessel is shown in FIG. 7. It is essentially the same as shown in FIG. 6, except that a comparator 53 is required. This comparator 53 has applied thereto the signals from the two amplifiers 52, 54. As long as the left and right drift sensors respectively 48 and 50 are illuminated by the radiation from the mooring buoy, there is no comparator output, and the motor and direction control remain inactivated. When a signal from one or the other of the sensors disappears, a comparator output signal is produced. The motor control equipment and automatic pilot are energized. However, an additional input to the automatic pilot 59 constitutes the outputs from the amplifiers 52 and 54. Which ever one of these is on, determines the direction in which the omnitug is turned in order to bring it back into the radiation beam 52. When the omnitug is back within the radiation beam 52, the timer 60, which also receives the output of the comparator, instructs the automatic pilot to steer the omnitug in a straight line course for a predetermined interval to insure that the hoses and mooring lines are extending out away from the buoy in the desired direction.

Figure 8:
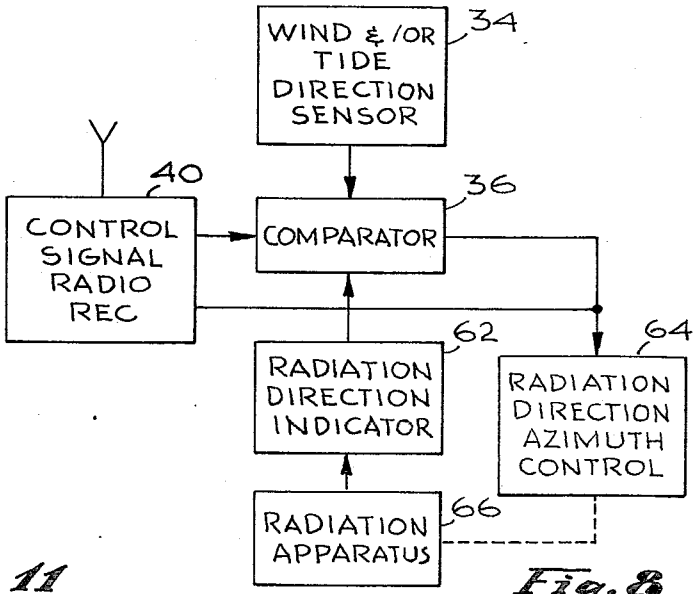
FIG. 8 is a block schematic diagram of the equipment required on a buoy for the embodiments of the invention represented in FIG. 6 and 7.

FIG. 8 is a block schematic diagram exemplary of the logic control equipment 28 which can be used on the buoy for radiating either one of two beams. Once again, a wind and/or tide direction sensor 34 is present on the buoy as well as a comparator, 36. One input to the comparator 36 constitutes the wind and/or direction sensor 28 output. Another input is from a circuit arrangement designated as radiation equipment direction indicator 62. This equipment, produces a signal indicative of the direction in which the rotatably mounted radiation apparatus is pointing. This equipment may be, for example, the type of azimuth indicating equipment which is used in radars. Even a potentiometer may be used, which produces as an output a signal, whose amplitude and polarity indicates the direction in which the radiation apparatus points. THe comparator output error signal is applied to radiation direction azimuth control 64. This equipment constitutes a motor and suitable transmission equipment responsive thereto which rotates the rotatably mounted radiation apparatus 66 in a direction to reduce the comparator error output signal. When the radiation direction indicator apparatus signal equals the signal from the wind and/or tide direction sensor the radiation apparatus is pointed in a desired direction.

Also provided is a control signal radio receiver 40, whose function as was previously described, is to inactivate the comparator and substitute instead the received signals in response to which the radiation azimuth direction control equipment rotates the radiation equipment to point in the direction desired for the omnitug 22 to move in order to bring the hoses and mooring lines to a ship.

Figure 9:
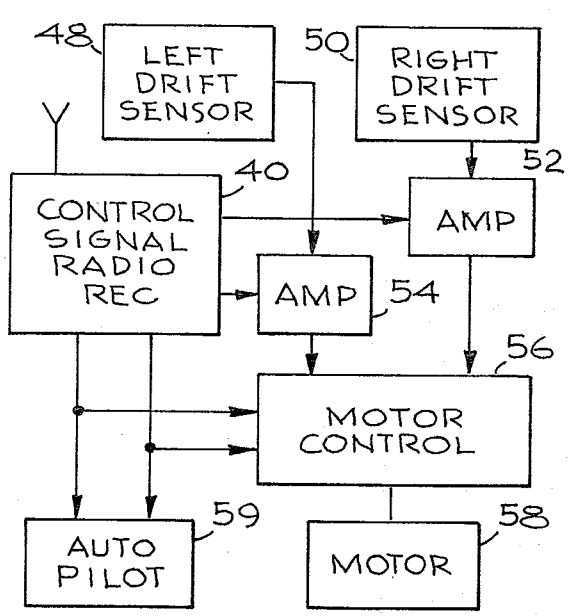
FIG. 9 is a schematic of the modification of FIG. 7 when a radio receiver is mounted on the vessel instead of on the buoy.

Alternative to the foregoing, the control signal radio receiver 40 may be placed on the omnitug. In that event, as shown in FIG. 9, the inactivating signal output from the radio receiver 40 inactivates the two amplifiers 52, 54 to prevent response to the radiated beam or beams. The vessel will thereafter respond to the signals from the control signal radio receiver.

Figure 10:
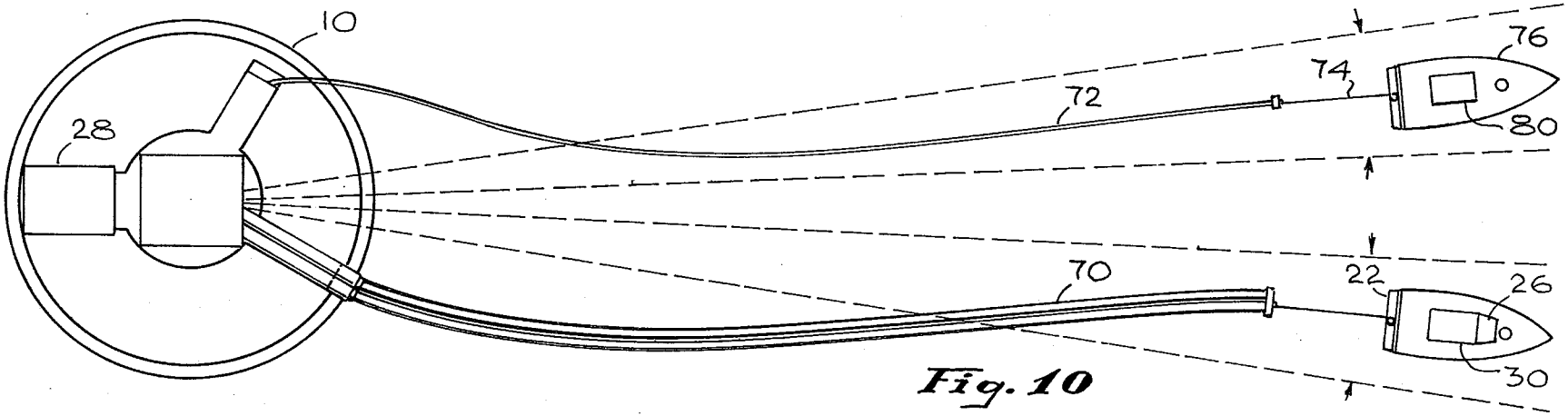
FIG. 10 is a plan view of an arrangement in accordance with this invention for separately maintaining a hose and mooring cable extending in desired directions.

FIG. 10 is a simplified plan view of another arrangement which may be desirable for extending the hoses and mooring line. The hoses 70, as before, are tethered to a vessel 22 and the hawser 72 and the mooring lines 74 are tethered to another vessel 76. Both omnitugs are equipped with either compass control equipment 78, 80, by way of example, or radiation sensors. Obviously if it is desired that the mooring line and the hoses extend in predetermined directions, one can duplicate the equipment already described for the hoses and for the hawsers and mooring line and maintain a control in that manner.

Figure 11:
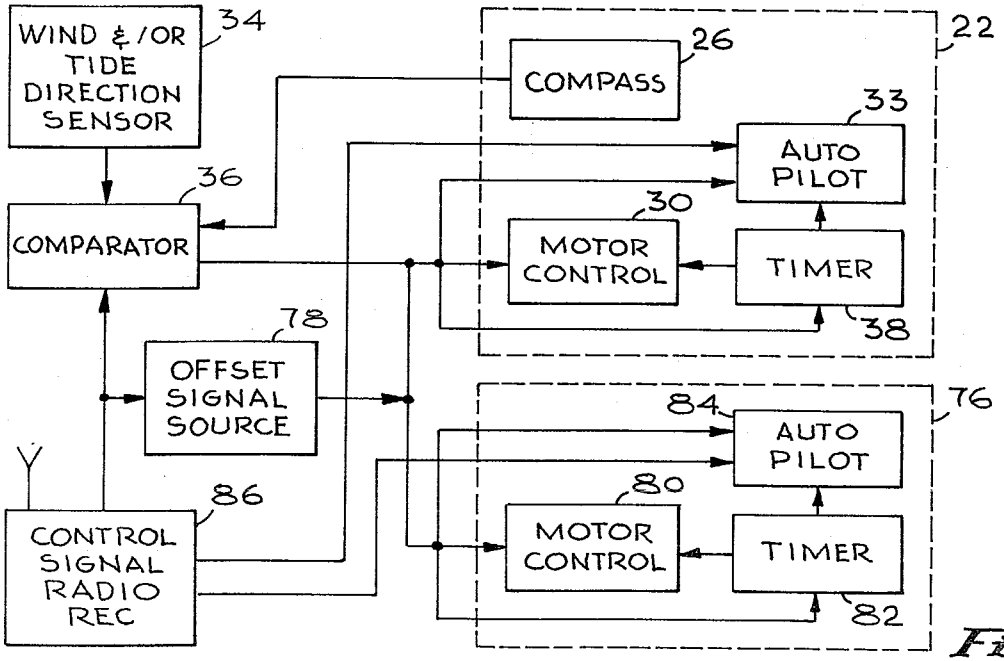
FIG. 11 is a block schematic diagram representing the electrical equipment required for the arrangement shown in FIG. 8.

A simplified arrangement for the logic control equipment which can be used is shown in FIG. 11, for exmaple, which is a schematic representation thereof. It includes the wind and/or tide direction sensor 34, the comparator 36, which receives the signals from the compass 26 which is on board the omnitug 22 which supports the hose. The comparator output, as previously described, is applied to the motor control 30 and automatic pilot equipment 34 for steering the omnitug 22 in the direction of the desired heading. The timer 38 then operates and assures that the hose will be stretched out. Since the comparator output is in the nature of an electrical signal, in order to produce a desired offset between omnitugs 22 and 76, an offset signal source 78 will provide an electrical signal which is algebraically combined with the comparator output signal to produce a resultant which, when responded to by the motor control 80 and automatic pilot equipment 84, which is on the omnitug 76, will align the mooring line at a desired offset angle from that of the hoses. The omnitug 76 is also provided with a timer 82 whose function it is, after the signal from the comparator has terminated, to apply a signal to the omnitug motor control and auto pilot for predetermined time so that the omnitug will pull on the mooring line for a predetermined length of time so that it may extend as far as possible in a reasonably straight line from the mooring buoy.

There is also provided a control signal radio receiver 86, which functions, in response to signals received either directly from a ship or from on shore, to inactivate the comparator and the offset signal source 78. Thereafter, under control of the radio signals, both omnitugs are steered to the waiting ship.

Figure 12:
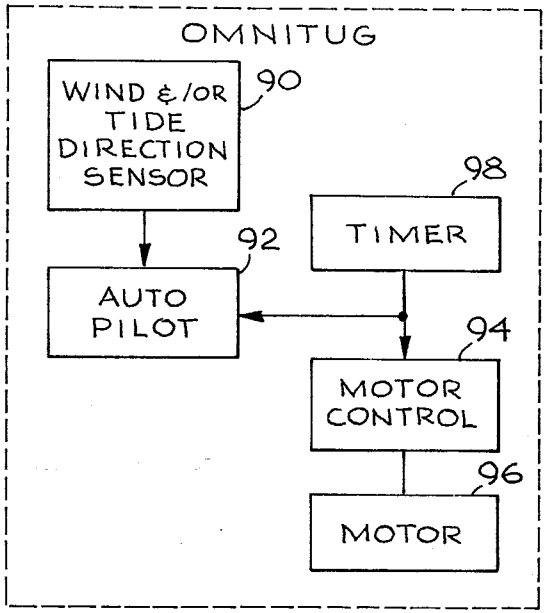
FIG. 12 illustrates the equipment required on a vessel for a simplified embodiment of the invention.

A simplified and most inexpensive arrangement, in accordance with this invention is one wherein there is no control equipment on the buoy. As shown in FIG. 12, the omnitug carries a wind and/or tide direction sensor 90. Its output is applied to an automatic pilot 92. However, this together with the propulsion motor control 94 and motor 96 are inactive, except when they are periodically turned on by a timer 98 for a predetermined interval. At that time the omnitug will correct its heading, if necessary and straighten out the hoses and mooring line.

In all of the arrangements thus far discussed for maintaining hoses and mooring lines extending in a predetermined direction a timer has been described as maintaining the omnitug operating, for a predetermined time after a correctiom action has taken place, in order to maintain the hoses and mooring lines stretched out in the predetermined direction.

Figure 13:
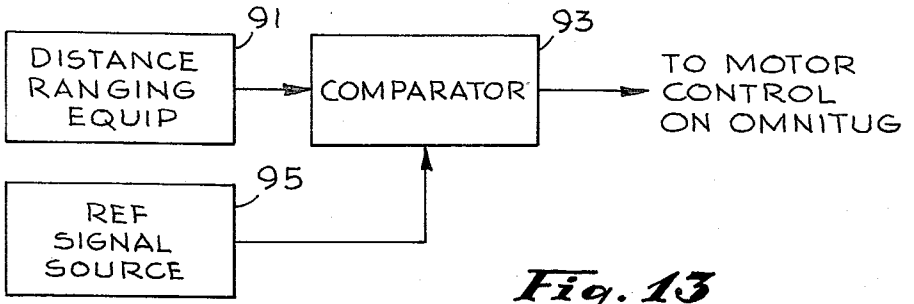
FIG. 13 is a schematic drawing of the electrical equipment required on a buoy when range detecting equipment is used.

In place of a timer, a simple radar or sonar ranging device can be on the buoy. This equipment is commercially purchaseable. A suitable signal reflector may either be mounted on the omnitug or on the hoses or on the hawser at a suitable location near the end. FIG. 13 shows schematically the additional electrical equipment on the buoy. This comprises the radar or sonar distance ranging equipment 91 which provides analog signals representative of distance of the omnitug or reflector location, which is applied to another comparator 93. A reference signal source 95 establishes an analog signal whose amplitude represents the minimum desired of the omnitug from the buoy. Whenever the signal representing the distance of the omnitug is less than the signal from the reference signal source the comparator provides an output which is applied to the motor control 30 in FIG. 3, in addition to the output of the comparator 36. The timer in FIG. 3 may be omitted. The motor control 30 turns on the motor whereby the omnitug will move in a direction indicated by the automatic pilot until the distance of the omnitug equals or exceeds the predetermined distance represented by the reference tug. Both distance and azimuth corrections can proceed simultaneously.

The distance ranging equipment, reference signals source and comparator may be located on the omnitug if desired in which event the reflector, if required, may be located on the buoy.

With the equipment described in FIG. 13, the timer may be omitted in the systems shown in FIGS. 6, 7 and 11 and the output of the comparator 92 may be applied directly to the motor control on the omnitug in each instance.

Figure 14:
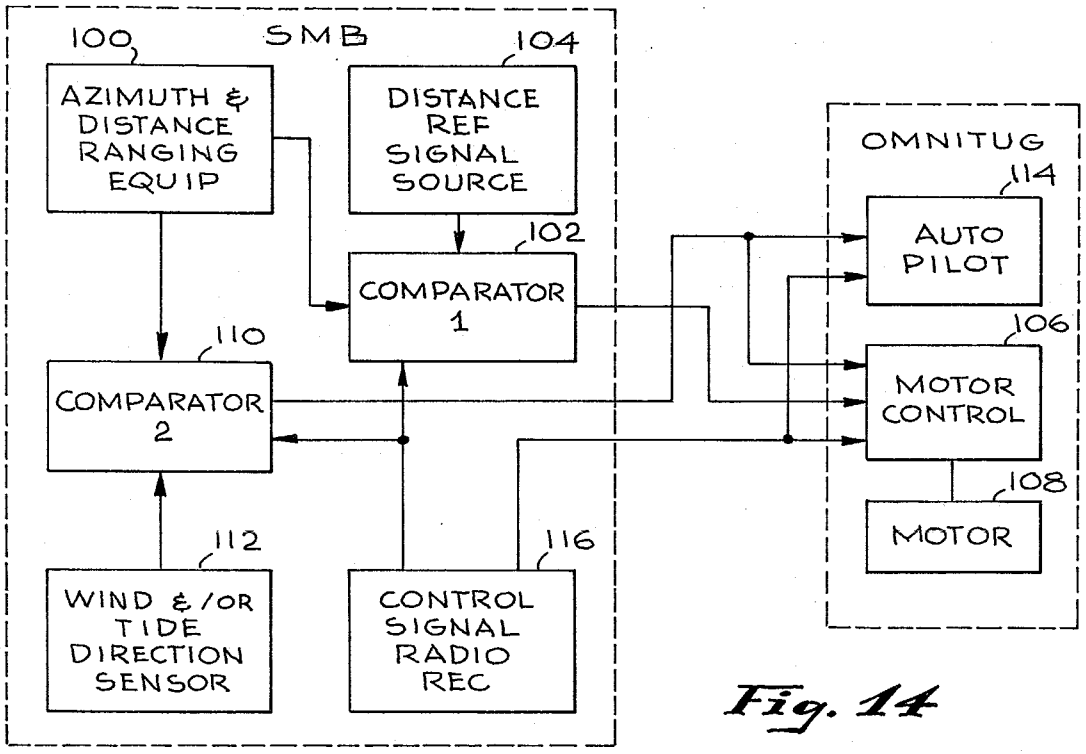
FIG. 14 is a schematic drawing of the electrical equipment used on a buoy and on the omnitug when continually operating distance and azimuth ranging equipment is used on the buoy.

Another system which can be used for maintaining hoses and mooring lines extending in a desired direction from the mooring buoy is schematically represented in FIG. 14. On the buoy is azimuth and distance ranging equipment 100 which can be either radar or sonar equipment. This equipment continuously scans the seas immediately surrounding the buoy and provides output signals which represent the azimuth and distance of the omnitug or a suitably positioned and modulated reflecting target. The distance representative signal is applied to a comparator 102 which compares this signal with one from a distance reference signal source 104. The comparator will provide an output to the motor control 106 on the omnitug which will enable it to turn on the motor 108 and propel the omnitug away from the buoy when the distance signal from the equipment 100 is less than the reference source distance signal.

A signal representing the azimuth location of the omnitug or angle its location makes with respect to a reference is a second output from the azimuth and distance ranging equipment. This signal is applied to a second comparator 110 to be compared with the signal output of a wind and/or tide direction sensor 112. If there is a deviation, the comparator 110 applies an output to the automatic pilot 114 and motor control 106 on the omnitug whereby it will start up its motor and be steered in a direction to minimize the output of comparator 110. A control signal radio receiver 116 is also provided, which when it receives control signals, inactivates both comparators and takes over control of the automatic pilot and motor control.

The omnitug may have any of the known propulsion and steering systems, such as a propeller and rudder, or a jet propulsion system. Another system, however, is one described and claimed in an application for "Bow Thruster" by Dashew, et al., Ser. No. 491,797, filed July 25, 1974. The "Bow Thruster" application describes a propulsion system in which, briefly described, a vessel has two openings, one on each side of its hull near the bow. These are preferably above the water line. A high pressure pump sucks up water from the sea and directs it at a valve which can be controlled to direct the water to one, or the other, or in varying degrees to both of the hull openings. In this manner a vessel can be propelled, steered or have its heading and position in the water maintained.

Using an omnitug equipped with a Bow Thruster instead of having the motor control, motor and automatic pilot on the omnitug, as shown previously herein, which in the case of the omnitug with a Bow Thruster would be a pump control, pump and automatic pilot equipment, which here would control valve equipment, instead of a rudder, the pump control, pump and automatic pilot equipment would all be on the buoy. These would be extended from the buoy to the omnitug two hoses which would carry the high pressure water to the two hull openings of the omnitug. The omnitug could then be moved and positioned at any location around the buoy by means of the water carried by these two hoses. This reduces considerably the amount of expensive equipment carried on the omnitug as well as its weight and thus eliminates possible expensive losses should the omnitug be lost.

Figure 15:
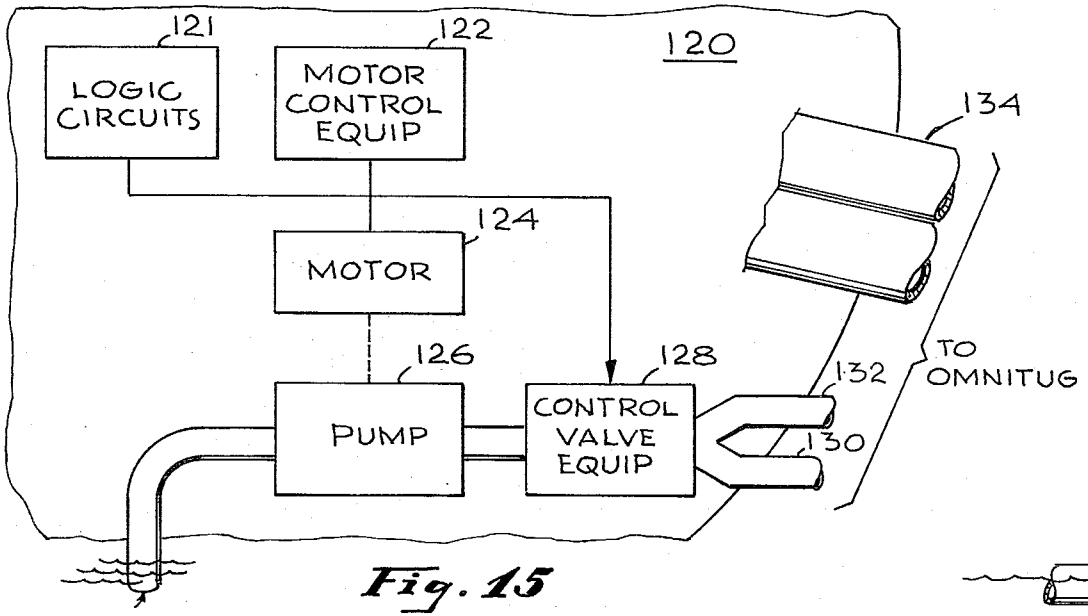
FIG. 15 is a schematic plan view illustrating a method and means for hydraulically controlling omnitug operation.

FIG. 15 is a plan schematic view of an arrangement which has just been described. The buoy 120 carries in addition to the logic circuits 121 of the type previously described, control equipment 122 for turning on and off underlogic equipment control, a motor 124, which drives a pump 126. The pump output is applied to control valve equipment 128. The control valve equipment, under control of the logic circuits permits the high pressure water received from the pump to go into one or the other or both of the hoses 130, 132, in varying degrees. These hoses extend with the hoses 134, until they reach the omnitug.

Another advantage which the Bow Thruster type or propulsion system provides is that it enables the placement of the omnitug at a location near the end of the hoses and/or mooring lines, instead of being attached to lines which are attached to the ends of the hoses and mooring lines. This shortens the length of extension from the buoy and reduces control lines as well as the amount of drift for which corrective action must be taken.

Figure 16:
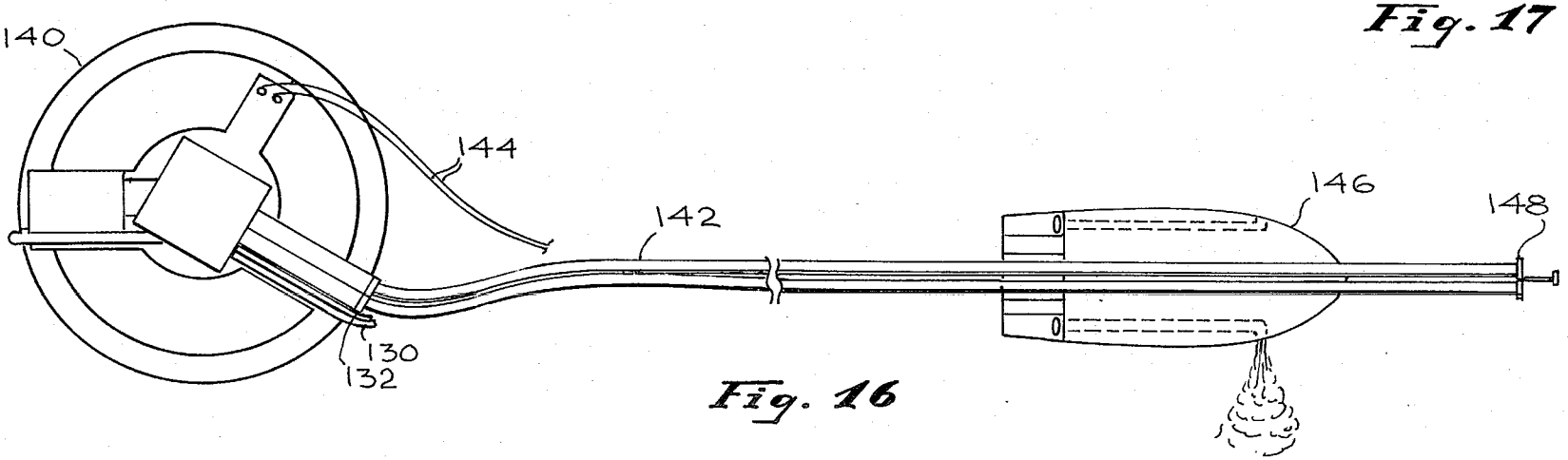
FIG. 16 is a plan schematic view illustrating an arrangement for this invention using a "Bow Thruster".

FIG. 16 shows schematically and in plan view a buoy 140, of the type described with hoses 142 and mooring lines 144 extending from the rotatable top of the bouy, an omnitug 146 is placed just far enough back from the other end 148 of the hoses and mooring lines so that these can be picked up to the deck of a vessel without pulling the omnitug out of the water. The omnitug may be remotely controlled in any of the ways previously described to position the hoses and mooring lines, but the simplest would be using two hoses extending from the valve control equipment, as shown in FIG. 13. The length of hoses and mooring line extending beyond the omnitug would not have to be much more than 100 feet. This length would not cause much, if any problem since it would be too far away from the buoy to wrap around it. There is considerable inherent stiffness in the hoses and mooring lines of the type used and so for a good part of the 100 feet extension the hoses and mooring line would extend fairly straight away from the omnitug.

Figure 18:
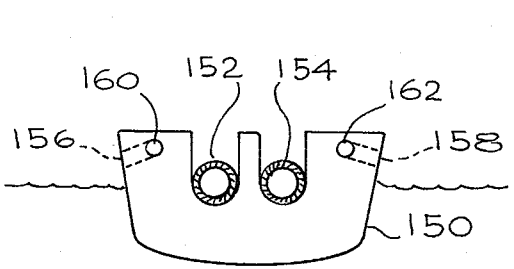
FIGS. 17 and 18 are fragmentary side and rear views of an omnitug and hoses carried thereon.
Figure 17:
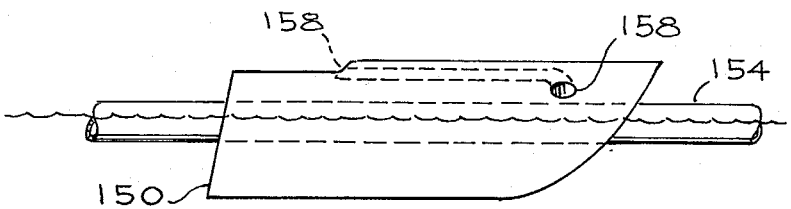

Using a Bow Thruster propelled omnitug, the hoses need not be picked out of the ocean or tied alongside, but in the arrangment shown in FIG. 15, they can pass through the hull. FIGS. 17 and 18 respectively are fragmentary side and rear views of an omnitug 150, having two hoses 152 and 154 by way of example passing therethrough at the normal level in the water at which they float. The omnitug hull has two openings 156, 158 therein to permit the Bow Thruster type of steering and propulsion. Two hoses, not shown extending from the buoy provided the required propulsion energy. These two hoses connect to openings 160, 162 in the hull. The omnitug hull may even be made into a section of the hoses if desired.

The arrangements shown in FIGS. 1, 4, 5, 10 and 13 may all be modified in accordance with the teachings of FIGS. 15 and 16.

It should be noted that while the description of the invention herein has referred to buoys which float on the surface of the sea and from which hoses and mooring lines extend, this should not be construed as a limitation upon the invention. It may also be used with mooring and tanker loading and unloading arrangements of the type where the buoy on the surface of the sea serves only as a mooring buoy and the hoses extend directly from a swivel arrangement on the sea floor to float therefrom upward and along the sea surface, or where both mooring and hoses extend to the surface from underneath the sea. Thus the scope of the claims are intended to cover such arrangements also.

It should further be noted that other propulsion systems and steering systems, than the ones described herein are intended to be covered by the claims. Such other systems may be, for example, ones which omit a rudder and instead have a propeller mounted on a swivel or a water jet propulsion device comprising a right angle pipe extending below the omnitug and emits water jets and can be swiveled to steer the omnitug. Also, while the description herein is directed to steering the omnitug left and right as well as straight ahead, in response to signals, this does not exclude the ability to instruct the omnitug to reverse its propulsion system for reversing its direction of motion, where required.

Finally, in stormy areas, hoses having negative flotation may be used to avoid the effects of storms. These hoses effectively are submerged, being roused when needed. It is within the scope and spirit of the invention and claims, that where required an omnitug may also have negative flotation and be submerged with the hoses while performing the operations specified herein. Accordingly, while the claims may call for the hoses to extend and float along the surface of the ocean, which is the usual case, this is not to be interpreted as a limitation on the claims which are also intended to apply to those situations where the hoses have negative flotation arrangements.

The embodiments of the invention in which an exclusive property or privilege is claimed are defined as follows:

1. In a tanker mooring a loading and unloading system of the type wherein pipes extend from a depot on shore, along the ocean bottom to a ship mooring means, said ship mooring means being provided with a swivel means to which hoses extend and from which hoses extend and float on the surface of the ocean said ship mooring means also including mooring line means extending therefrom and floating on the surface of said ocean, the improvement comprising boat means attached to said floating hoses and said mooring line means, means for generating heading signals representative of said boat means heading, mean for generating direction signals representing a desired direction for said hoses and said mooring line means to extend, including a wind and tide direction sensor means for generating desired direction signals representative of the wind and tide direction, means for comparing said heading and wind and tide direction signals and generating error signals indicative of the difference between the two, means on said boat means responsive to said error signals to cause said boat means to move in said desired direction thereby causing said floating hoses and said mooring line means to extend in said desired direction, and means for instructing said boat means to move away from said ship mooring means when it is less than a predetermined distance from said ship mooring means.

2. In a tanker mooring and loading and unloading system as recited in claim 1 wherein said boat means includes timer means responsive to said error signals for maintaining said boat means moving in said desired direction for a predetermined interval after said boat means is heading in said desired direction.

3. In a tanker mooring and loading and unloading system as recited in claim 1 wherein there is included means for establishing reference signals representing a predetermined distance desired for the location of said vessel from said ship mooring means, means for generating distance signals representative of the distance of said vessel from said ship mooring means, means for comparing said reference and distance signals and generating second error signals representative of the difference between the two when said reference signals are greater than said distance signals, and means responsive to said second error signals for causing said boat means to move in the direction of its heading until said second error signals are nullified.

4. In a tanker as recited in claim 1 wherein said means for generating signals representing a desired direction for said hoses and said mooring lines to extend includes a wind and tide direction sensor means for generating heading signals representative of a direction in which it is desired that said floating hoses and mooring lines means extend, means on said buoy for transmitting radiations in said desired direction responsive to said direction signals, and means on said boat responsive to said radiations for generating said direction signals.

5. In a tanker as recited in claim 4 wherein said means on said buoy for transmitting radiations in said desired direction includes means for transmitting two different frequency radiation beams which diverge at a predetermined angle, said means on said boat responsive to said radiations includes a first sensor means responsive only to one of said radiation frequencies for generating first direction signals, a second sensor means responsive only to a second of said radiation frequencies for generating second direction signals, said means on said boat means responsive to said direction signals to cause said boat means to move in said desired direction includes automatic pilot means responsive to said first and second direction signals to steer said boat to a heading between said first and second radiations.

6. In a tanker as recited in claim 4 wherein said means on said buoy for transmitting radiations in said desired direction includes means for transmitting a single radiation beam having a width within which it is desired to maintain said boat, said means on said boat responsive to said radiations includes a first sensor means for generating a first direction signal when it no longer detects said single radiation beam, and a second sensor means for generating a second direction signal when it no longer detects said single radiation beam, said means on said boat means responsive to said direction signals to cause said boat means to move in said desired direction includes automatic pilot means responsive to said first and second direction signals to steer said boat to a heading within said single radiation beam.

7. In a tanker mooring and loading and unloading system as recited in claim 1 wherein said means for generating direction signals representing a desired direction for said hoses and said mooring line means to extend comprises radio receiver means for receiving signals indicative of a desired direction along which said hoses and said mooring line means should extend and including means responsive to said received signals for converting said received signals to direction signals.

8. In a tanker mooring and loading and unloading system as recited in claim 1 wherein said means for generating direction signals includes a wind and tide direction sensor means on said ship mooring means for generating signals representative of wind and tide, a first and second hose extending from said ship mooring means to said boat means, valve means for determining the flow of water to one or the other or both of said first and second hoses responsive to said wind and tide signals, and pump means for pumping ocean water to said valve means, said means on said boat means responsive to said direction signals includes a first and a second ejection openings on other side of the hull of said boat means to which said respective first and second hoses are connected for discharging the water pumped through said hoses to thereby propel and steer said boat means.

9. In a tanker mooring loading and unloading means as recited in claim 1 wherein there is a separate boat means attached to said floating hoses and to said mooring line means.

10. In a tanker mooring and loading and unloading system of the type wherein there is a single point mooring means from which hoses and mooring lines extend and float on the surface of the ocean, the improvement comprising tug means to which said floating hoses and mooring lines are attached, means for causing said tug means to move along a desired course including means on said single point mooring means for generating direction signals representative of a desired heading for said tug, means on said tug responsive to said direction signals for moving said tug to assume said desired heading, means on said single point mooring means for generating distance signals representative of the distance of said tug from said single point mooring means, means on said single point mooring means to generate a signal representative of a minimum distance from said single point mooring means desired for said tug, means for comparing said distance signal with said minimum distance signal and generating an error signal when said distance signal is less than said minimum signal, and means on said tug responsive to said error signal to move said tug until said error signal is minimized.

11. In a tanker mooring and loading and unloading system as recited in claim 10, wherein said means on said single point mooring means for generating direction signals includes means for sensing wind and tide directions and generating direction signals respective thereof, radio receiver means for receiving signals indicative of a desired heading for said tug, and including means for generating direction signals responsive to said received signals, and means for inactivating said means for sensing wind and tide direction signals and generating signals representative thereof while said means for generating direction signals responsive to said received signals is operative.

12. In a tanker mooring and loading and unloading system as recited in claim 10 wherein said means on said single point mooring means for generating direction signals representative of a desired heading for said tug includes means for detecting the heading of said tug and generating heading signals, means for sensing wind and tide direction and genrating wind and tide signals representative thereof, means for comparing said heading signals and said wind and tide signals and generating error signals representative of any difference, and means to move said tug responsive to said error signals to minimize said error signals.

13. In a tanker mooring and loading and unloading system of the type wherein there is a single point mooring means from which hoses and mooring lines extend and float on the surface of the ocean, the improvement comprising tug means to which said floating hoses and mooring lines are attached, means for causing said tug means to move along a desired course including a first and second hose extending from said single point mooring means to said tug, valve means for determining the flow of water to one or the other or both of said hoses, pump means for pumping ocean water to said hose means, first and second ejection openings on either side of the hull of said tug means to which said respective first and second hoses are connected to discharge the water pumped through said hoses to thereby propel and steer said tug, and means for controlling said valve means to maintain said tug at a desired heading and distance from said single point mooring means to thereby cause said floating hoses and mooring lines to extend in a desired direction from said single point mooring means.

14. In a tanker mooring and loading and unloading system as recited in claim 13 wherein said means for controlling said valve means includes wind and tide direction sensing means for generating signals representative of said wind and tide direction, and means responsive to said signals for controlling said valve means to cause said tug to head in said wind and tide direction.

15. In a tanker mooring and loading and unloading system as recited in claim 13 wherein said means for controlling said valve means includes radio receiver means for receiving signals indicative of a desired heading for said tug and generating direction control signals responsive thereto, and means for controlling said valve means responsive to said direction control signals.

* * * * *